US005873222A

United States Patent [19]

Mueller

[11] Patent Number: 5,873,222

[45] Date of Patent: Feb. 23, 1999

[54] APPARATUS FOR PROTECTING A FOOD

[76] Inventor: Martin Mueller, 4929 E. Lake Shore Dr., Wonder Lake, Ill. 60097

[21] Appl. No.: 64,891

[22] Filed: Apr. 23, 1998

Related U.S. Application Data

[62] Division of Ser. No. 939,582, Sep. 29, 1997.

[51] Int. Cl.[6] ..... B65B 11/00

[52] U.S. Cl. ..... 53/585; 53/176; 53/221; 53/540

[58] Field of Search ..... 53/176, 221, 540, 53/585

[56] References Cited

U.S. PATENT DOCUMENTS 2,303,420 12/1942 Amberg et al. .
2,371,668 3/1945 Balton .
2,445,713 7/1948 Glassner .
3,710,931 1/1973 Hollinger .
4,136,800 1/1979 Christner et al. .
4,289,791 9/1981 Weinstein .
4,313,965 2/1982 Weinstein .
4,529,470 7/1985 Weinstein .
5,228,267 7/1993 Blankenship et al. .
5,379,569 1/1995 Mueller .

*Primary Examiner*—Daniel B. Moon
*Attorney, Agent, or Firm*—Mathew R. P. Perrone, Jr.

[57] ABSTRACT

A conveyor apparatus conveys cones lying on the side to a predetermined point. Prior to reaching the predetermined point, an edible adhesive is applied to the side of each cone. At the predetermined point, a paper wrap is applied to the cone and adhered thereto. The first cone is then stacked with a second cone and more cones, followed by packing for transport.

11 Claims, 4 Drawing Sheets

APPARATUS FOR PROTECTING A FOOD

CROSS REFERENCE TO RELATED APPLICATION

This application is a divisional application of U.S. patent application Ser. No. 08/939,582 as originally filed on Sep. 29, 1997.

This invention relates to a method and apparatus for protecting an ice cream cone and similar food items, and more particularly to a method and apparatus for applying a protective device to the ice cream cone of any desired shape and similar food items so that only the final consumer of the ice cream cone touches the actual cone.

BACKGROUND OF THE INVENTION

With the awareness of the public regarding contaminated foods, the requirements for sanitation are greater than ever before. The requirements for sanitation these days are so extreme, that there is a even a substantial amount of interference with the enjoyment of the ever popular ice cream cone.

Customarily, edible containers known as cones are manufactured, nested or sacked one within another, packaged, and shipped to an end user. Each cone is removed from the package one at a time and is sold by the end uses to a consumer. Customarily, there is no cover on each cone as it is removed from the package. So a cone, first removed from the package, can come into direct skin contact with someone other than the end consumer.

Since the development of the ice cream cone at the St. Louis World's Fair about one hundred years ago, an ice cream cone is known to produce great enjoyment. An ice cream store can have many varieties of ice cream and hand pack the desired flavor into the desired cone. It is difficult to accomplish this function under the extreme sanitary conditions of today.

These and other factors are thoroughly discussed in U.S. Pat. No. 5,379,569; incorporated herein by reference. The referenced patent and this application have the same inventive entity.

Typical cone shapes for receiving ice cream are those pointed cones, which have a geometric cone shape and taper to a point at one end, and those flat based cones, which have a flat base in order to permit the cone to stand upright unsupported on a flat surface and contain ice cream or other food therein. Both the flat based cones and the pointed cones need protection. The cited patent shows an efficient paper protection application to a flat based cone, only to the base of the flat based cone.

If such a procedure can applied to both types of cones, great advantages are achieved. Such advantages are further increased if the same machine can treat the pointed cone and the flat-based cone, especially with little or no modification.

However, sanitation and cleanliness are even more important in the food industry. It is difficult to avoid direct skin to food contact in an ice cream cone. With the widespread fear of infectious disease, the enjoyment of an ice cream cone can be substantially reduced.

Furthermore, a cone containing ice cream is known to leak. When a cone leaks, at least the person's hands become soiled or sticky. Such stickiness is uncomfortable at best and damaging to a person's clothes at worst.

Also, it is advisable to have a cleaning device available for solving this problem. If the cone can be protected while at the same time providing this cleaning device, a great advantage is obtained.

SUMMARY OF THE INVENTION

Among the many objectives of this invention is the provision of an edible cone capable of containing ice cream or similar food with a protective covering removably adhered to the side of a cone.

A further objective of this invention is to provide a flat based, edible cone having a protective cover adhered thereto.

A still further objective of this invention is to provide a pointed cone with a removable protective cover adhered thereto.

Yet a further objective of this invention is to provide an nestable or stackable edible cone with a protective cover.

Also an objective of this invention is to provide a method for placing a protective cover on a cone.

Another objective of this invention is to provide a method removably applying a protective cover to an edible cone.

Yet another objective of this invention is to provide a method for stacking a plurality of covered cones.

Still another objective of this invention is to provide a method for forming a cover for a cone.

These and other objectives of the invention (which other objectives become clear by consideration of the specification, claims and drawings as a whole) are met by providing an apparatus for conveying cones lying on the side to a predetermined point. Prior to reaching the predetermined point, an edible adhesive is applied to the side of each cone. At the predetermined point, a paper wrap is applied to the cone and adhered thereto. The first cone is then stacked with a second cone and more cones, followed by packing for transport.

BRIEF DESCRIPTION OF THE DRAWINGS

Throughout the figures of the drawings, where the same part appears in more than one figure of the drawings, the same number is applied thereto.

DESCRIPTION OF THE PREFERRED EMBODIMENTS

Assuming that the cone is formed, the cones are placed in a lying down position or on the side thereof on the conveyor of an apparatus. The cones, thus positioned, are conveyed, each cone to the same specified position, for receiving a spot of adhesive. After this point, each cone receives a paper wrap in sheet form. Just before each cone reaches the specified point of paper wrap application thereto, an edible adhesive is applied, to the side of the cone. Clearly the cones are exposed to the adhesive. Preferably, the cones are conveyed lying down.

More particularly, after the eatable adhesive is applied to the side of the cone, paper is taken from the paper source, is cut into a paper wrap, and is adhered to the adhesive spot on each of the cones. A ramming device or other stacking device then forces each cone into a stacking assembly and a package, thereby forming the paper around the side and the bottom of each of the cones. The pressure of the ram adheres the paper to the adhesive spot on the side of the cone and wraps the rest of the paper around the side of the cone.

As the cones are removed from the packaging, the paper is available to permit gripping of the cone. The paper prevents contact of the cones by a human hand and permits the consumer of the cone to avoid drips while at the same time providing a paper with which the hands may be cleaned after the cone is consumed. In this fashion a substantial advantage is obtained over the standard cone procedures.

The conveyor belt moving the cones to the adhesive applicator has a series of ridges thereon. Each ridge is capable of supporting a cone. The support comes by each ridge contacting a top edge of a cone, be it a flat based cone or a pointed cone. Each cone is moved under an adhesive dispenser, so that a spot of edible adhesive may be placed thereon.

Preferably, the conveyor belt has a slight upward angle from the horizontal. This structure permits the central axis of the cone to substantially coincide with the central axis of the package. The angle of the conveyor belt may be adjusted to make the central axes substantially parallel to the ground.

It also suitable at times to have a cone centering device to center the cone on the paper after the adhesive has been applied to the cone. By such additional positioning, the paper may be more efficiently applied to the cone.

Figure 1:
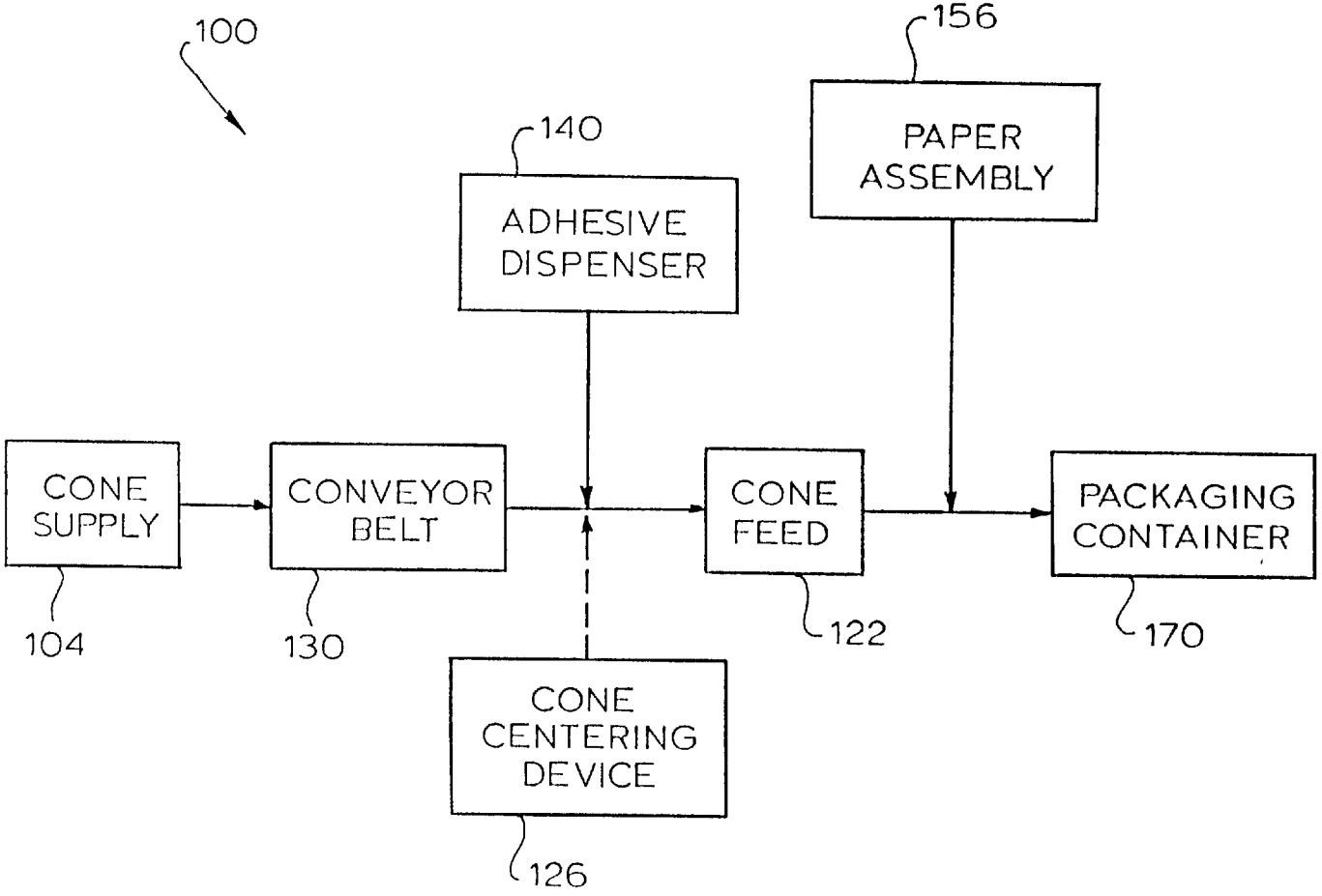
FIG. 1 is a block diagram depiction of the cone stacking apparatus 100 of this invention.

Referring now to FIG. 1, cone stacking apparatus 100 receives a cone supply 104 of prepared cones suitable for holding ice cream or other food (not shown). Cone stacking apparatus 100 includes a conveyor belt 130. Conveyor belt 130 causes cone supply 104 to pass an adhesive dispenser 140. At that point the adhesive dispenser 140 places a spot of edible adhesive 142 (FIG. 2) on the side of each cone. Then each cone of cone supply 104 passes to a cone feed 122.

Figure 4:
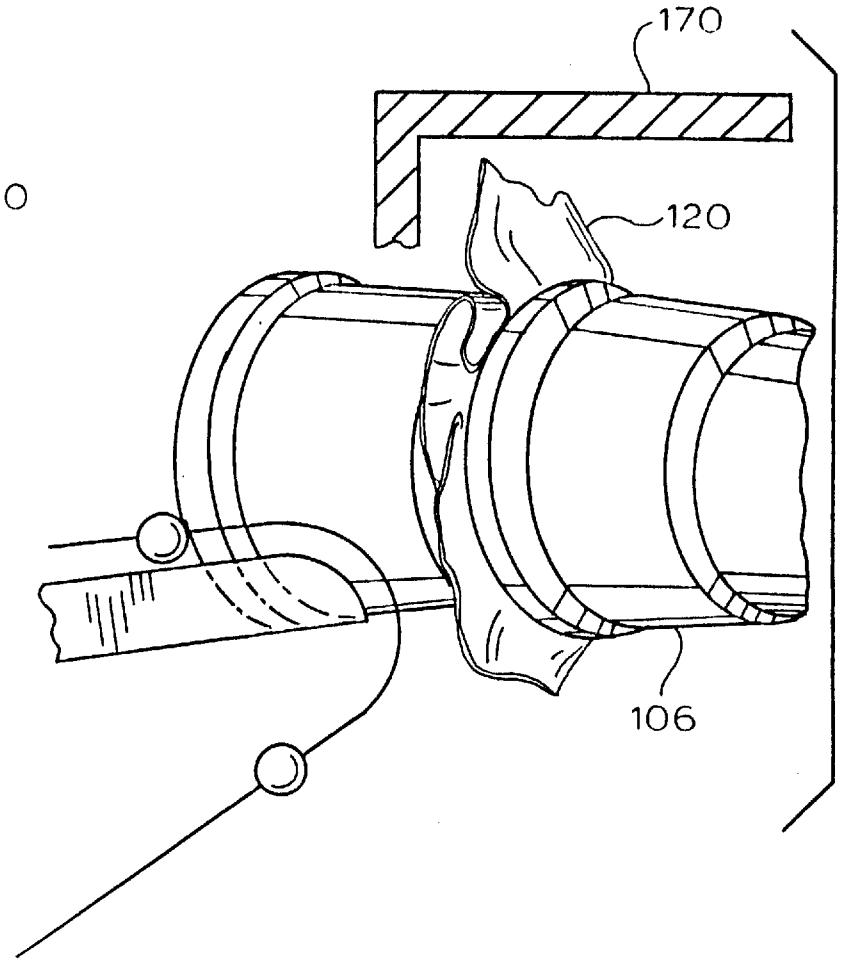
FIG. 4 depicts a perspective view of the flat based cone 106 having paper cover 120 applied thereto and stacked with a second flat based cone 106.

Simultaneously, paper assembly 156 (FIG. 2) is providing a paper wrap 146 to the cone feed 122. Paper assembly 156 includes a paper roll or paper supply 162 feeding paper 160 (FIG. 3) to a cutter. Then paper wrap 146 is applied to each cone of cone supply 104 passes at a cone feed 122, and formed into a cone stack 124 in packaging container 170 (FIG. 4).

Figure 2:
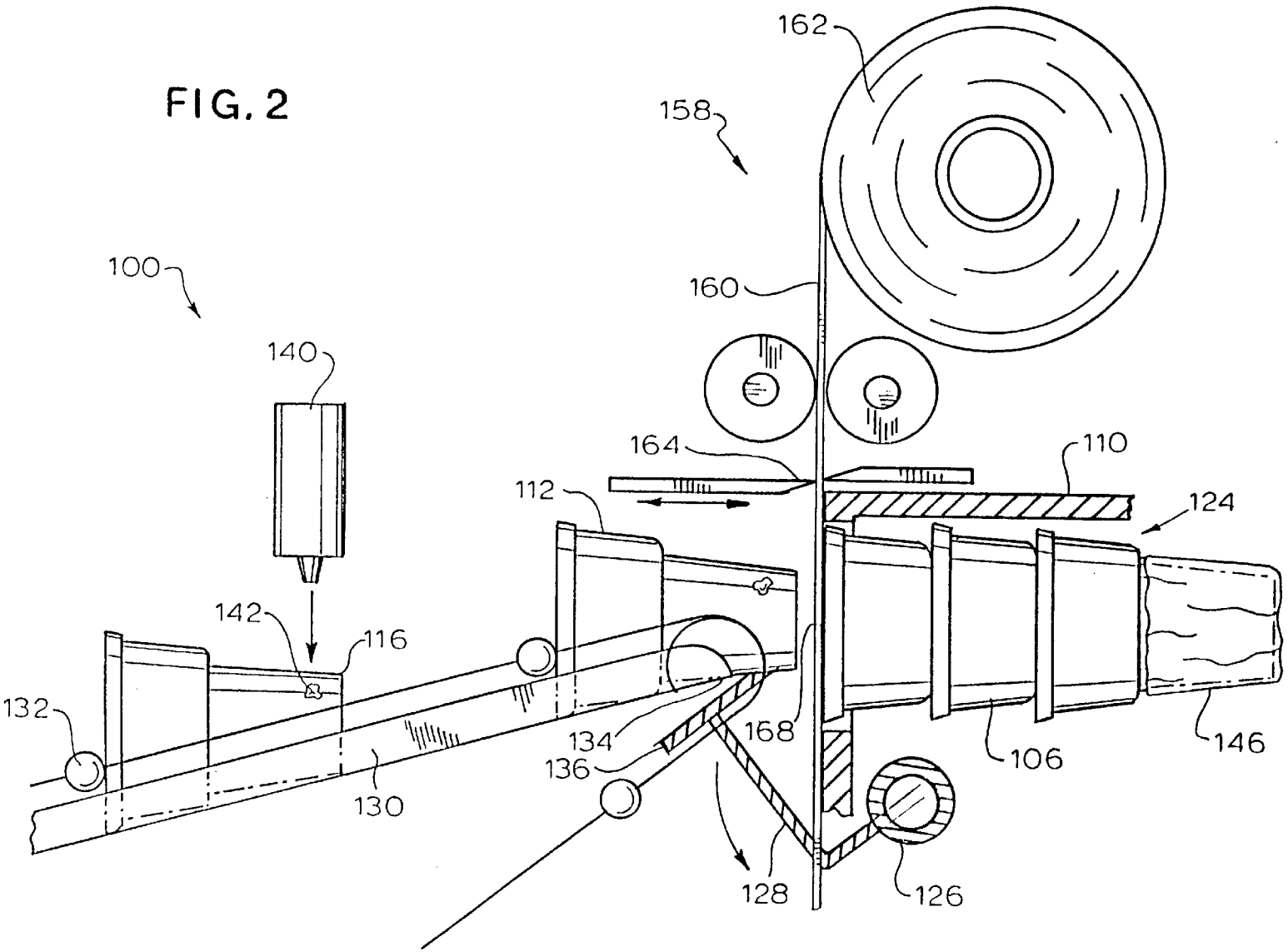
FIG. 2 depicts a side view of the cone stacking apparatus 100 of this invention used with a series of the flat based cone 106.

Referring now to FIG. 2, a flat based cone 106 suitable for holding ice cream or other food (not shown) are provided to cone stacking apparatus 100. Cone stacking apparatus 100 includes a conveyor belt 130. The flat based cone 106 is on its side 116 on conveyor belt 130.

The conveyor belt 130 includes a plurality of ridges 132. Each ridge 132 contacts a cone 106 and causes the cone 106 to pass an adhesive dispenser 140. At that point the adhesive dispenser 140 places a spot of edible adhesive 142 on the side 116 of flat based cone 106.

After the adhesive 142 is applied, between the conveyor belt 130 and the paper 160, may be a cone centering device 126. Cone centering device 126 is secured by arm 128 adjacent conveyor end 134. Arm 128 has a cone arc sleeve 136 positioned to center the cone 106 on the paper 160.

Then paper 160 is cat by cutter 164 from paper roll 162 to form paper wrap 146 as flat based cone 106 approaches paper 160. Paper wrap 146 is then applied to side 116 of the flat based cone 106 as a first cone 106 is nested into second cone 106 and placed in package 110.

Figure 3:
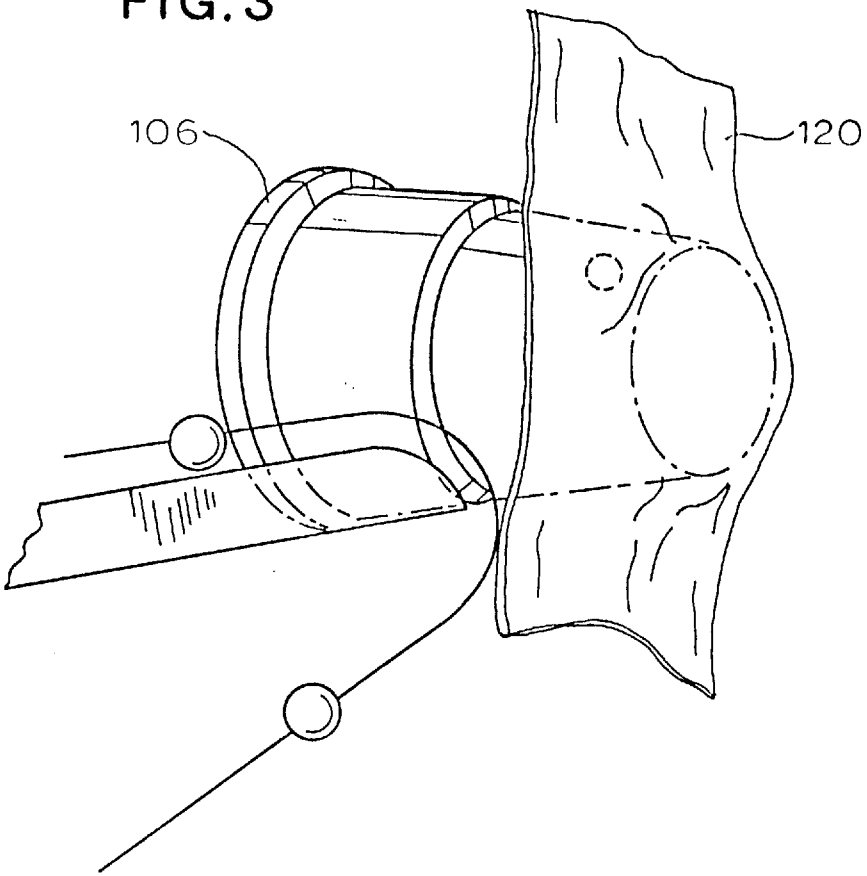
FIG. 3 depicts a perspective view of the flat based cone 106 having paper cover 120 applied thereto.

Adding FIG. 3 and FIG. 4 to the consideration, the flat based cone 106 has paper cover 120 applied thereto and stacked with a second flat based cone 106. More particularly, the thus adhesive spotted flat based cone 106 passes then to the package 110. Ridges 132 push the cone into a horizontal package 110. The horizontal package 110, conveyor belt 130 and adhesive dispenser 140 are powered in a standard fashion. Once the key features and devices described are assembled in the manner described herein, the appropriate completion steps become clear.

Situated above the conveyor belt 130 at the conveyor end 134 is a paper assembly 158. Paper assembly 158 includes paper 160 mounted on a roll 162 which passes to a paper cutter 164. The paper cutter 164 first cuts a paper wrap 146 from paper roll 162. Then paper cutter 164 feeds a paper wrap 146 to a cone aperture 168 of sufficient size to permit the flat based cone 106 to pass therethrough. As the flat based cone 106 passes through the cone aperture 168, a paper wrap 146 adheres to the adhesive spot 142 and proceeds into the container 114.

As subsequent cones with paper sheet or wrap 146 adhered thereto are pushed into container 114, the nesting capability of the flat based cone 106 forces the paper sheet or wrap 146 therearound. The spot of edible adhesive 142 holds the paper sheet or wrap 146 on the flat based cone 106 in the proper fashion.

As the flat based cone 106 is moved in an upward direction toward the paper sheet or wrap 146, the paper sheet or wrap 146 adheres to the flat based cone 106 at adhesive point 142 and is pushed into the container 114. With repeat of this procedure, a stack 112 of flat based cone 106 is formed with the paper sheet or wrap 146 adhered thereto and wrapped therearound.

As the flat based cone 106 comes out of the package 170 contact is made substantially only with the paper sheet or wrap 146. As the flat based cone 106 is filled by the server (not shown), contact With the flat based cone 106 in minimized. The consumer (not shown) of the flat based cone 106 may remove the paper sheet or wrap 146 as the flat based cone 106 is consumed.

The paper sheet or wrap 146 may also serve, both as a hand wipe after the flat based cone 106 and contents thereof are consumed and a device for preventing drips from the flat based cone 106 down to the hands of the person. The paper sheet or wrap 146 may also conserve and reduce waste of a flat based cone 106, because a flat based cone 106 with minor cracks is Still useable due to the protection provided by the paper sheet or wrap 146. Accordingly, this apparatus 100, by applying the paper sheet or wrap 146 increases the utility and reduces the waste of the flat based cone 106.

It may be seen how the paper sheet or wrap 146 goes around the sides of the flat based cone 106. The adhesive spot 142 holds the paper sheet or wrap 146 in position as the stack 112 is formed. The forming of the stack 112 forces the paper sheet or wrap 146 to wrap around the flat based cone 106.

Figure 5:
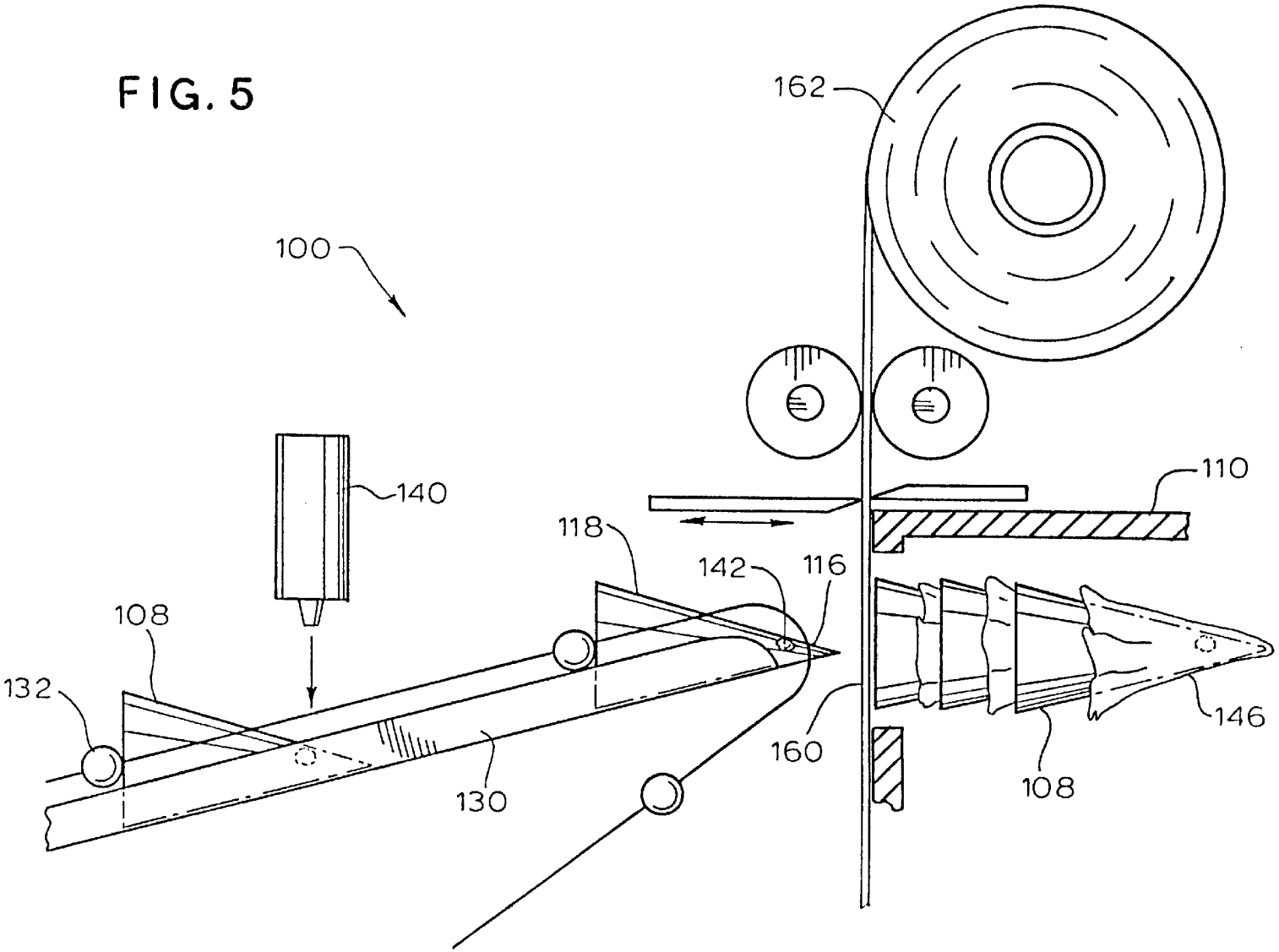
FIG. 5 depicts a side view of the cone stacking apparatus 100 of this invention used with a series of the pointed cone 108.

Referring now to FIG. 5, a pointed cone 108 suitable for holding ice cream or other food (not shown) are provided to cone stacking apparatus 100. Cone stacking apparatus 100 includes a conveyor belt 130. The pointed cone 108 is on its side 116 on conveyor belt 130. The conveyor belt 130 includes a plurality of ridges 132. Each ridge 132 contacts a cone 106 and causes the pointed cone 108 to pass the adhesive dispenser 140. At that point the adhesive dispenser 140 places a spot of edible adhesive 142 on the side 116 of pointed cone 108.

Then paper 160 is cut by cutter 164 from paper roll 162 form paper wrap 146 as pointed cone 108 approaches paper 160. Paper wrap 146 is then applied to angled side 118 of the pointed cone 108 as a first pointed cone 108 is nested into second pointed cone 108 and placed in package 110.

Cone centering device 126 may or may not be used here as desired. Usually cone centering device 126 permits a faster, more efficient speed for conveyor belt 130. Thus, cone centering device 126 is usually preferred.

This application—taken as a whole with the specification, claims, abstract, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

What is claimed and sought to be protected by Letters Patent of the United States is:

1. An apparatus for conveying and packaging a plurality of cones comprising:

(a) the apparatus including a conveying means for at least one cone in order to move the at least one cone to at least a first desired position;

(b) the conveying means including a support means for each of the at least one cone;

(c) the apparatus including an adhesive dispensing means for applying an edible adhesive to a side portion of each cone;

(d) the apparatus including a wrap dispensing means for applying and adhering a wrap to the cone to form at least one wrapped cone;

(e) the apparatus including a packaging means for the at least one wrapped cone;

(f) the at least one cone having a top portion, a bottom portion oppositely disposed from the top portion, and the side portion connecting the top portion and the bottom portion;

(g) the conveying means supporting the at least one cone in a lying position on the side portion;

(h) the support means for each of the at least one cone being adapted to contact a top portion of the at least one cone; and (i) the support means serving to convey the at least one cone to and past the adhesive dispensing means.

2. The apparatus of claim 1 further comprising:

(a) the wrap dispensing means applying and adhering a wrap to the at least one cone after the adhesive dispensing;

(b) the wrap dispensing means including a cutting means for forming the wrap; and (c) a stacking device cooperating with the wrap dispensing means to stack a plurality of cones into a stacked assembly and a package, thereby forming the wrap around the side portion and the bottom portion of each of the plurality of cones.

3. The apparatus of claim 2 further comprising:

(a) the support means for each of the at least one cone being a ridge on a conveyor belt adapted to contact the top portion of the cone; and (b) the ridge being adapted to support an edible cone selected from the group consisting of a pointed base cone and a flat base cone.

4. The apparatus of claim 3 further comprising:

(a) the conveyor belt having a slight upward angle from the horizontal, thereby permitting a central axis of each cone to substantially coincide with a central axis of the package; and (b) an angle adjusting means changing the upward angle of the conveyor belt.

5. The apparatus of claim 4 further comprising:

(a) a cone centering device being adjacent to the wrap dispensing means and the packaging means;

(b) the cone centering device serving to position each cone for the wrap dispensing means and the packaging means;

(c) the wrap dispensing means including a paper assembly to feed the cutting means; and (d) the paper assembly and the cutting means cooperating to form the wrap.

6. An apparatus for conveying and packaging a plurality of cones comprising:

(a) the apparatus including a conveying means for at least one cone in order to move the at least one cone to at least a first desired position;

(b) the conveying means including a support means for each of the at least one cone;

(c) the at least one cone having a top portion, a bottom portion oppositely disposed from the top portion, and a side portion connecting the top portion and the bottom portion;

(d) the conveying means supporting the at least one cone in a lying position on the side portion;

(e) the apparatus including a adhesive dispensing means for applying an edible adhesive to the side portion of each cone;

(f) the apparatus including a wrap dispensing means for applying and adhering a wrap to the cone to form at least one wrapped cone;

(g) the apparatus including a packaging means for the at least one wrapped cone;

(h) a cone centering device being adjacent to the wrap dispensing means and the packaging means;

(i) the cone centering device serving to position each cone for the wrap dispensing means and the packaging means;

(j) the wrap dispensing means including a paper assembly and a cutting means;

(k) the paper assembly feeding the cutting means; and (l) the paper assembly and the cutting means cooperating to form the wrap.

7. The apparatus claim 6 further comprising:

(a) the cone centering device including a centering arm mounted adjacent to the paper assembly and the conveying means;

(b) the centering arm supporting a cone arc member adjacent to the wrap dispensing means; and (c) the cone arc member serving to guide a cone to a central portion of a wrap formed from the wrap dispensing means.

8. The apparatus of claim 7 further comprising:

(a) the conveying means supporting the at least one cone in the lying position;

(b) the support means for each of the at least one cone being adapted to contact the top portion of the at least one cone; and (c) the support means serving to convey the at least one cone to and past the adhesive dispensing means.

9. The apparatus of claim 8 further comprising:

(a) the wrap dispensing means applying and adhering a wrap to the at least one cone after the adhesive dispensing;

(b) the wrap dispensing means including the cutting means for forming the wrap; and (c) a stacking device cooperating with the wrap dispensing means to stack a plurality of cones into a stacked assembly and a package, thereby forming the wrap around the side portion and the bottom portion of each of the plurality of cones.

10. The apparatus of claim 9 further comprising:

(a) the support means for each of the at least one cone being a ridge on a conveyor belt adapted to contact the top portion of the cone; and (b) the ridge being adapted to support an edible cone selected from the group consisting of a pointed base cone and a flat base cone.

11. The apparatus claim 10 further comprising:

(a) the conveyor belt having a slight upward angle from the horizontal, thereby permitting a central axis of each cone to substantially coincide with a central axis of the package; and (b) an angle adjusting means changing the upward angle of the conveyor belt.

* * * * *